US007555999B2

(12) United States Patent
Stretch

(10) Patent No.: US 7,555,999 B2
(45) Date of Patent: Jul. 7, 2009

(54) COLD TEMPERATURE OPERATION FOR ADDED MOTION VALVE SYSTEM

(75) Inventor: Dale A Stretch, Novi, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/528,995

(22) Filed: Sep. 28, 2006

(65) Prior Publication Data

US 2007/0089695 A1 Apr. 26, 2007

Related U.S. Application Data

(60) Provisional application No. 60/729,709, filed on Oct. 24, 2005.

(51) Int. Cl.
*F01L 9/02* (2006.01)

(52) U.S. Cl. ..... 123/90.12; 123/90.15; 123/90.16

(58) Field of Classification Search ..... 123/90.12, 123/90.15, 90.11, 90.16, 90.17
See application file for complete search history.

(56) References Cited

U.S. PATENT DOCUMENTS

| | | | | |
|---|---|---|---|---|
| 3,140,698 | A | 7/1964 | Voorhies | |
| 3,938,483 | A | 2/1976 | Firey | |
| 4,009,694 | A | 3/1977 | Firey | |
| 4,373,477 | A | 2/1983 | Buente et al. | |
| 4,671,221 | A | 6/1987 | Geringer et al. | |
| 4,862,844 | A | 9/1989 | Wakeman et al. | |
| 4,972,761 | A | 11/1990 | Thomsen et al. | |
| 5,251,587 | A | 10/1993 | Mori et al. | |
| 5,460,129 | A | 10/1995 | Miller et al. | |
| 5,640,934 | A | 6/1997 | Mori et al. | |
| 5,680,841 | A | 10/1997 | Hu | |
| 6,223,846 | B1 | 5/2001 | Schechter | |
| 6,321,706 | B1 | 11/2001 | Wing | |
| 6,457,487 | B1 | 10/2002 | Stephenson et al. | |
| 6,477,997 | B1 | 11/2002 | Wakeman | |
| 6,655,349 | B1 | 12/2003 | Cavanagh | |
| 2002/0017256 | A1 | 2/2002 | Shiraishi et al. | |
| 2002/0066428 | A1 | 6/2002 | Kammerdiener et al. | |
| 2003/0213444 | A1 * | 11/2003 | Cornell et al. | 123/90.12 |
| 2004/0055564 | A1 * | 3/2004 | Crowell et al. | 123/316 |
| 2005/0087716 | A1 | 4/2005 | Udd | |
| 2005/0205019 | A1 | 9/2005 | Burk et al. | |

FOREIGN PATENT DOCUMENTS

| | | |
|---|---|---|
| FR | 2287583 | 5/1976 |
| NL | 6400029 | 7/1964 |

* cited by examiner

*Primary Examiner*—Zelalem Eshete
(74) *Attorney, Agent, or Firm*—Honigman Miller Schwartz & Cohn LLP

(57) ABSTRACT

A hydraulic circuit in fluid communication with an added motion valve system is disclosed. The hydraulic circuit in fluid communication with an added motion valve system includes at least a first valve that permits flow of a fluid in a first fluid supply channel to an added motion actuator volume by way of a first fluid port and a second fluid port and at least a second valve that permits flow of the fluid in a second fluid supply channel to the first fluid port, the second fluid port, and a third fluid port. A method for controlling a hydraulic circuit in fluid communication with an added motion valve system is also disclosed.

20 Claims, 6 Drawing Sheets

COLD TEMPERATURE OPERATION FOR ADDED MOTION VALVE SYSTEM

RELATED APPLICATION

This disclosure claims the benefit of Provisional Patent Application No. 60/729,709, filed on Oct. 24, 2005.

TECHNICAL FIELD

The present disclosure relates generally to a system that provides a delayed closing movement for an engine valve of an internal combustion engine, including a system that provides controlled engine valve seating and controlled added motion closing movement for a valve over a wide range of fluid temperatures/viscosities.

BACKGROUND

It is known in the art that a cam system, which may include, for example, a cam shaft and rocker arm, can be employed to open and close a valve of an internal combustion (IC) engine. An example of a standard cam profile engine valve opening/closing curve 300*a* is generally shown in FIG. 5.

The timing of engine valve closure during an IC engine's induction stroke may be varied to, among other things, optimize the performance of the engine. Variable valve timing in the closing of the engine valve can be accomplished by, for example, employing a hydraulic force actuator that counteracts the closing force of the valve spring. As generally illustrated in FIG. 5, the delayed closing movement of the engine valve (generally represented in the Figure by 301) is often referred to as an "added motion."

Although current added motion systems can provide a desired delayed closing movement of an engine valve, temperature and viscosity variations of an associated fluid, such as, for example, engine oil, may result in an inconsistency in the timing of the closing of the engine valve. FIG. 5 generally illustrates a seating variation (shown generally by segment 403).

Accordingly, a need exists to provide an added motion system that can provide controlled engine valve seating and controlled added motion closing movement to a valve over a wide range of fluid temperatures and/or viscosities.

BRIEF DESCRIPTION OF THE DRAWINGS

Embodiments of the disclosure will now be described, by way of example, with reference to the accompanying exemplary drawings, wherein.

DETAILED DESCRIPTION

Figure 1:
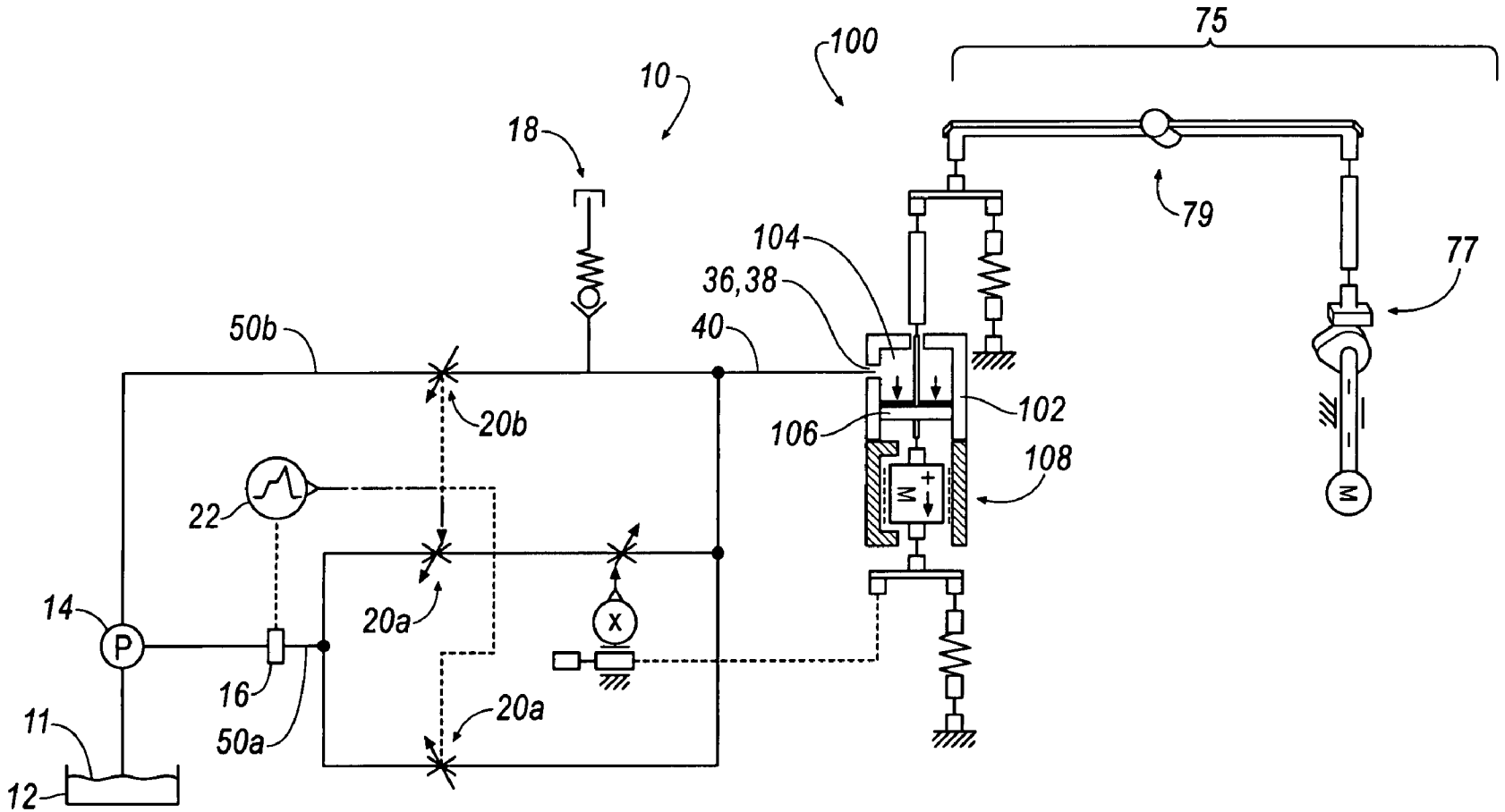
FIG. 1 is a schematic of a system for operating one or more added motion valves according to an embodiment.

FIG. 1 generally illustrates an embodiment of the disclosure showing a hydraulic circuit 10 in fluid communication with an added motion valve system 100. The hydraulic circuit 10 includes a sump 12 associated with a fluid 11, a pump 14, a fluid temperature sensor 16, one or more check valves 18, one or more valves 20*a*, 20*b*, and a controller 22. The valves 20*a*, 20*b* may comprise a solenoid valve. According to an embodiment, the valves 20*a*, 20*b* may be spring-offset single-solenoid valves, or, alternatively, a dual-solenoid having any desirable fluid flow path, such as, for example, a single flow path or a parallel flow path.

An embodiment of the added motion valve system 100 may include a cam system, which is shown generally at 75. The illustrated cam system 75 generally includes a camshaft 77 and a rocker arm 79. The valve system 100 is generally shown to include, among other things, an engine valve housing cradle including an added motion valve body 102 having a bore 104, a piston 106 disposed in the bore 104, and an engine valve 108. The bore 104 may generally define an added-motion actuator volume that receives a volume of fluid 11 for controlling the movement and seating of the engine valve 108. According to an embodiment, the volume of fluid 11 is provided to the bore 104 at one or more ports which are shown generally at 36 and 38 (FIGS. 2 and 3) and at 40 (FIG. 4).

Figure 5:
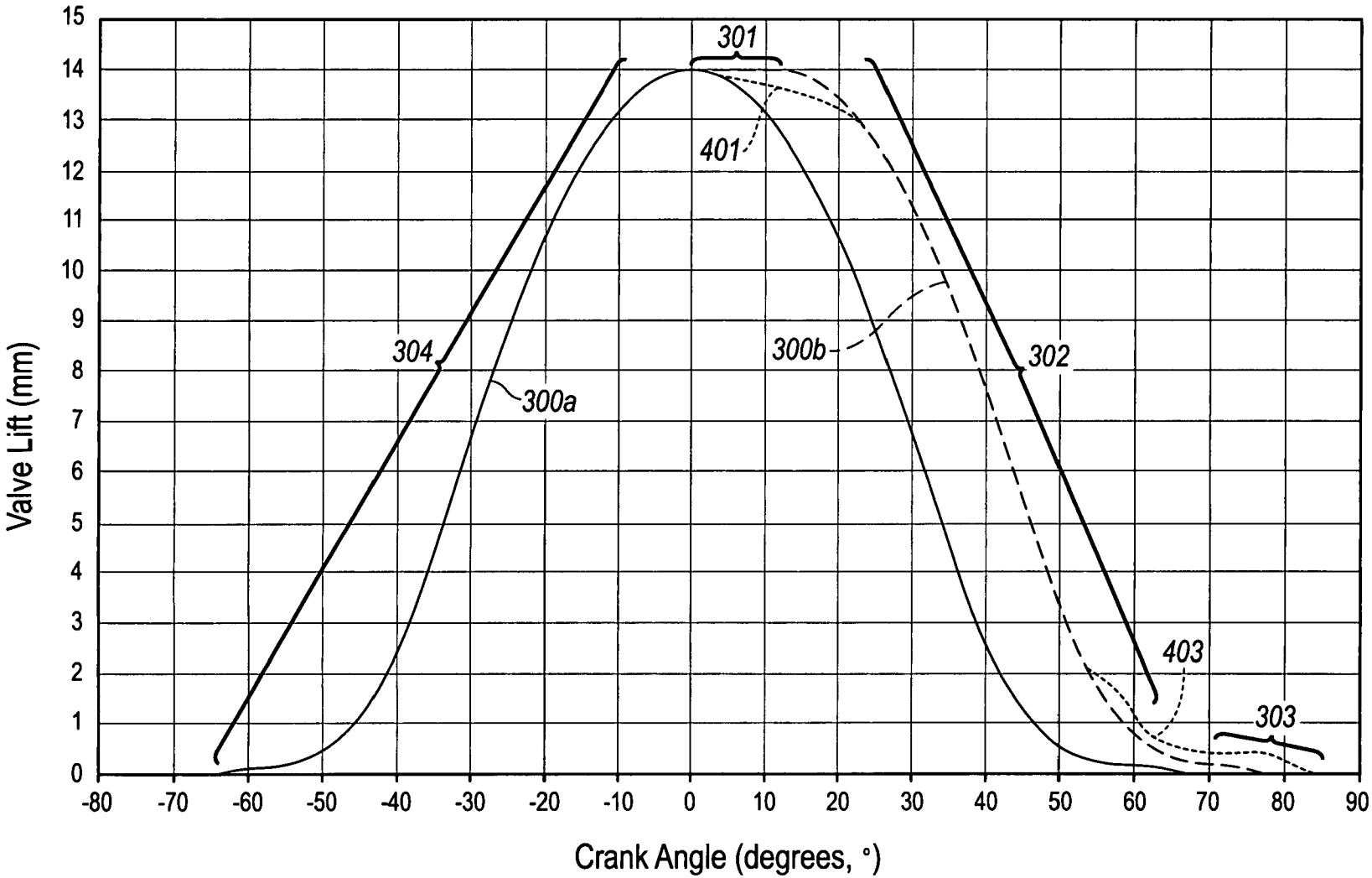
FIG. 5 is a graph that generally illustrates a cam valve lift timing profile and an added motion valve lift timing profile according to an embodiment.

Referring to FIGS. 1 and 5, the hydraulic circuit 10 may be, for example, an "added motion"-type valve system whereby the cooperation of the volume of fluid 11 trapped in the actuator volume 104 by way of one or more of the valves 20*a*, 20*b* provides an added-motion valve curve, which is shown generally at 300*b*. The valves 20*a*, 20*b* may be moved to either an open position or a closed position to permit or prevent movement of the fluid 11 in and out of the actuator volume 104 so that the engine valve 108 is allowed to either freely reciprocate in an opening/closed stoke movement, or, prevent a free reciprocation of the engine valve 108 in the opening/closed stroke movement.

At any time before or during an opening stroke 304, the controller 22 may control one or more of the valves 20*a*, 20*b*, such as, for example, the valve 20*a*, which may be referred to as an added motion actuator valve, to move from an open position/configuration to a closed position/configuration. Movement of the valve 20*a* to a closed position can trap a volume of the fluid 11 in the actuator volume 104 to lock, or substantially lock, the engine valve 108 during a closing stroke 302 for a period of time. The amount of time may be determined or selectively controlled by controller 22. Such an "added motion" movement of engine valve 108 is generally represented by the curve identified by 300*b*, and a "locked" added motion stroke of the engine valve 108 is shown generally at 301. Thus, for example, when the valve 20*a* is closed, the fluid 11 can be controllably trapped in the actuator volume 104 and further movement of the engine valve 108 from a locked or open position to a closed position may be delayed until the valve 20*a* is reconfigured from a closed position to an open position.

As illustrated in FIG. 1, the piston 106 is generally disposed inside of the actuator volume 104, between the engine valve 108 and the rocker arm 79 of the cam system 75. Accordance to an embodiment, the piston 106 may engage, either one of, or both, a retainer (not shown) and the engine valve 108. According to an embodiment, the actuator volume 104 may be directly disposed between an engine valve actuator (e.g. the cam system 75 and/or the rocker arm 79) and an engagement end of the engine valve 108. Thus, it will be appreciated that actuator volume 104 of the "added motion"-type valve system may be non-integral with the engine valve 108.

Figure 2:
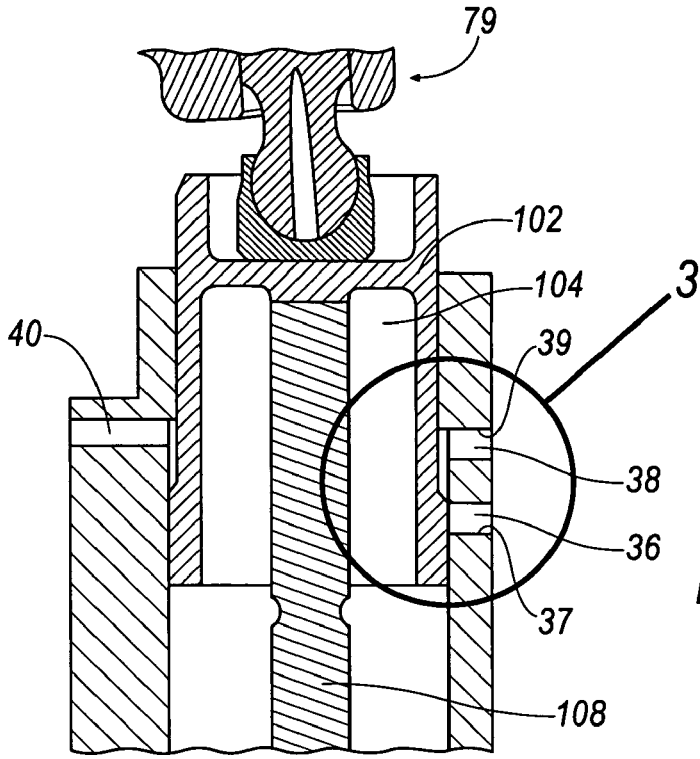
FIG. 2 is a cross-sectional view of an added motion valve according to an embodiment.
Figure 3:
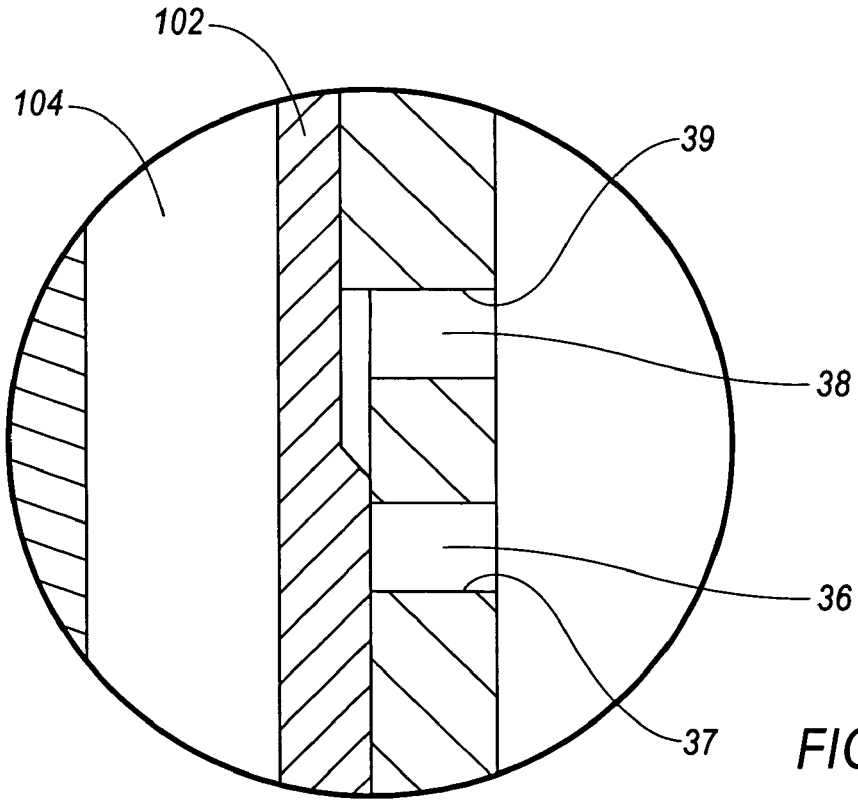
FIG. 3 is an enlarged view of FIG. 3 according to line 3.
Figure 4:
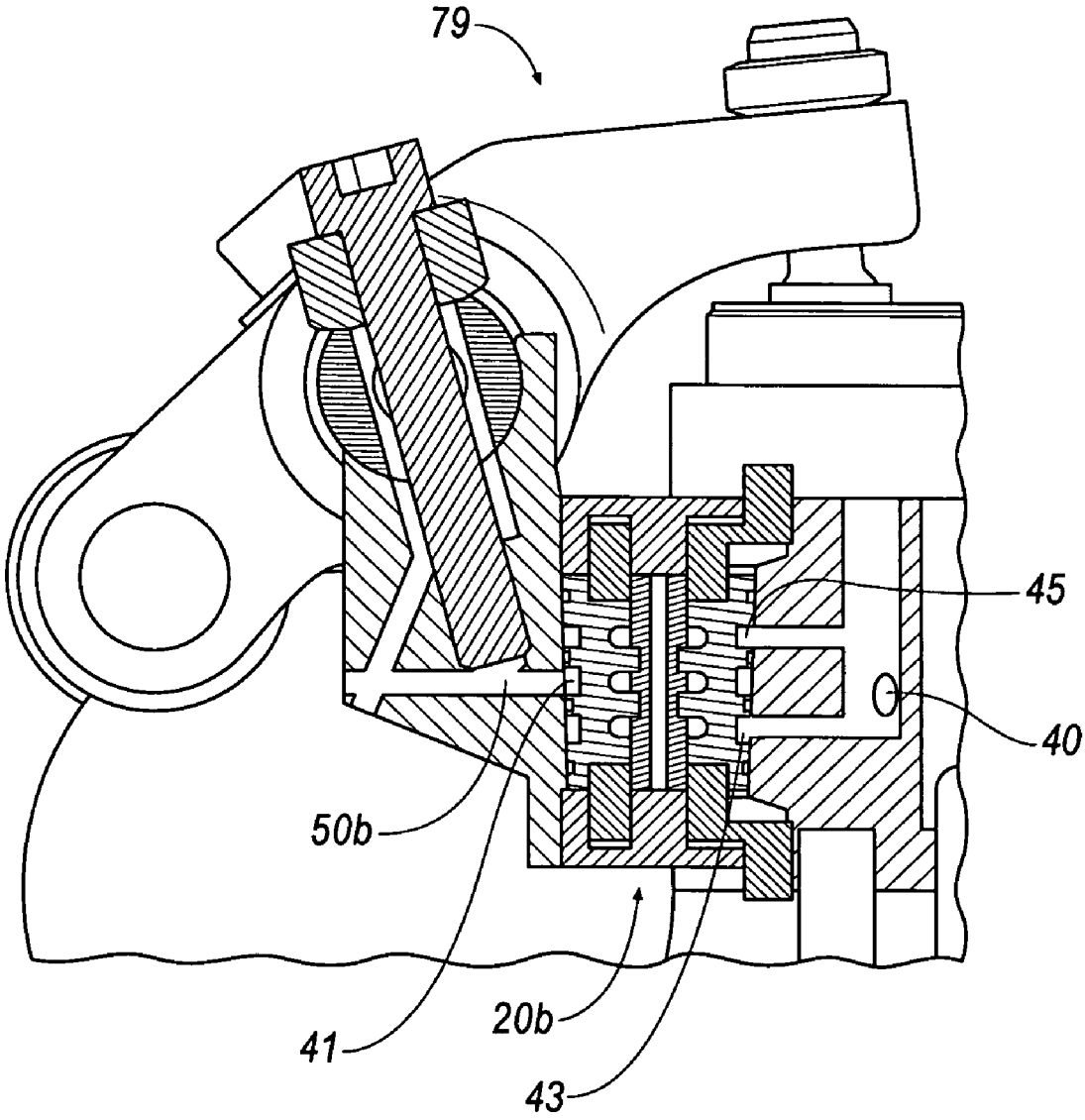
FIG. 4 is a partial cross-sectional view of an added motion valve system according to an embodiment.

Referring to FIGS. 1-3, the movement of the fluid 11 to the actuator volume 104 by way of a first fluid supply channel 50*a* is shown according to an embodiment. In operation, the fluid 11 flows through the first fluid supply channel 50*a* to the valve 20*a* and is provided to the actuator volume 104 by way of the first and second ports 36, 38. As seen in FIGS. 2 and 3, due to the relative positioning of the first and second ports 36, 38, the first port 36 may be referred to as a bottom port and the second port 38 may be referred to as a top port.

In operation, the top port 38 provides a flow of fluid, for example, to the actuator volume 104 at a rate of approximately 1-liter-per-minute to control seating velocity of the engine valve 108 whereas the bottom port 36 provides a flow of fluid, for example, to the actuator volume 104 at a rate of approximately 22-liters-per-minute to set the closing speed of the engine valve 108. According to an embodiment, fluid communication to the bottom port 36 is exposed for an engine valve lift in the range approximately equal to 1-14 mm whereas fluid communication to the top port 38 is exposed for all engine valve lifts. Although the above description discusses an engine valve lift range approximately equal to 1-14 mm, it will be appreciated that the disclosure is not limited to a range of 1-14 mm and that any desirable range may be included.

According to an embodiment, the bottom and top ports 36, 38 may include a variable diameter orifice 37, 39 that refines the amount of fluid flow into the actuator volume 104 depending on the temperature of the fluid 11. Feedback of the fluid temperature may be provided by the fluid temperature sensor 16 and control of the diameter of the orifice 37, 39 may be provided by the controller 22.

Referring now to FIGS. 1 and 4, the movement of the fluid 11 to the actuator volume 108 by way of a second fluid supply channel 50*b* is shown according to an embodiment. In operation, the fluid 11 flows through the second fluid supply channel 50*b* and the valve 20*b* to provide the fluid 11 to the actuator volume 104 by way of the third port 40, which may also be referred to as a cold temperature port. As illustrated, the second fluid supply channel 50*b* is located at a feed-side of the valve 20*b* for providing the fluid 11 from the sump 12 to the valve 20*b*. Relative the location of the first and second ports 36, 38, the valve 20*b* is shown between the second fluid supply channel 50*b* and the third port 40. As such, the fluid 11 is provided to the valve 20*b* at a first valve opening 41 by way of the second fluid supply channel 50*b* so that the fluid 11 may move into the valve 20*b* and out through a lower valve opening 43 and an upper valve opening 45. As illustrated, the lower and upper valve openings 43, 45 are in fluid communication with the third port 40.

In operation, the valve 20*b* may be referred to as a cold temperature on/off valve and is utilized when the added motion valve system 100 is operated in cold temperatures. According to an embodiment, the valve 20*b* may be moved from an initially closed orientation to an open orientation during cold temperature operation of the added motion valve system 100 to compensate, at least in part, for different oil/fluid 11 viscosities resulting from different fluid operating temperatures to provide a more consistent seating 303 and delayed movement/locking 401 of an engine valve 108.

Figure 6A:
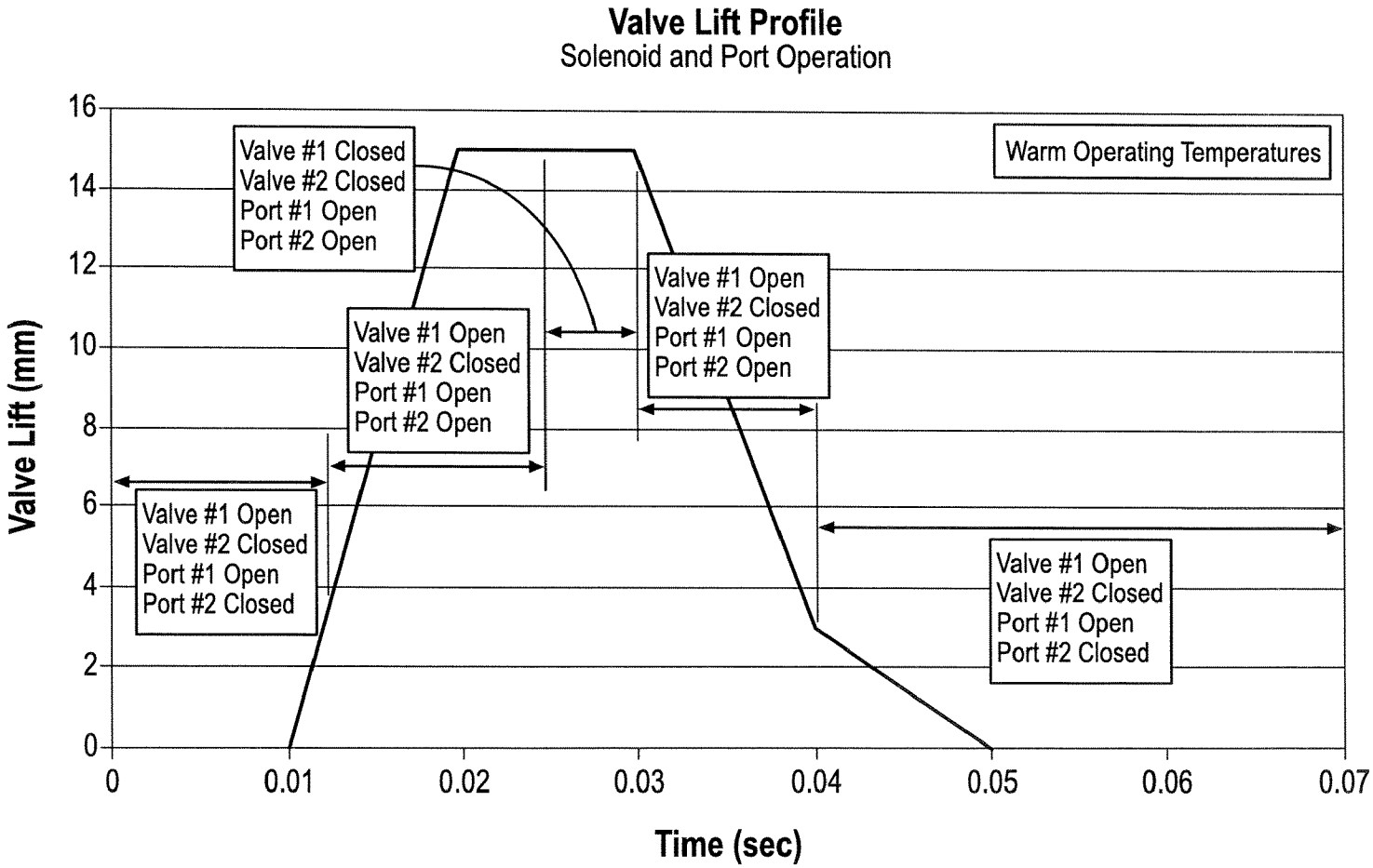
FIG. 6A is a graph that generally illustrates an open/closed valve configuration curve of the system of FIG. 1 when the system is operated under warm temperatures in accordance with an embodiment of the invention.
Figure 6B:
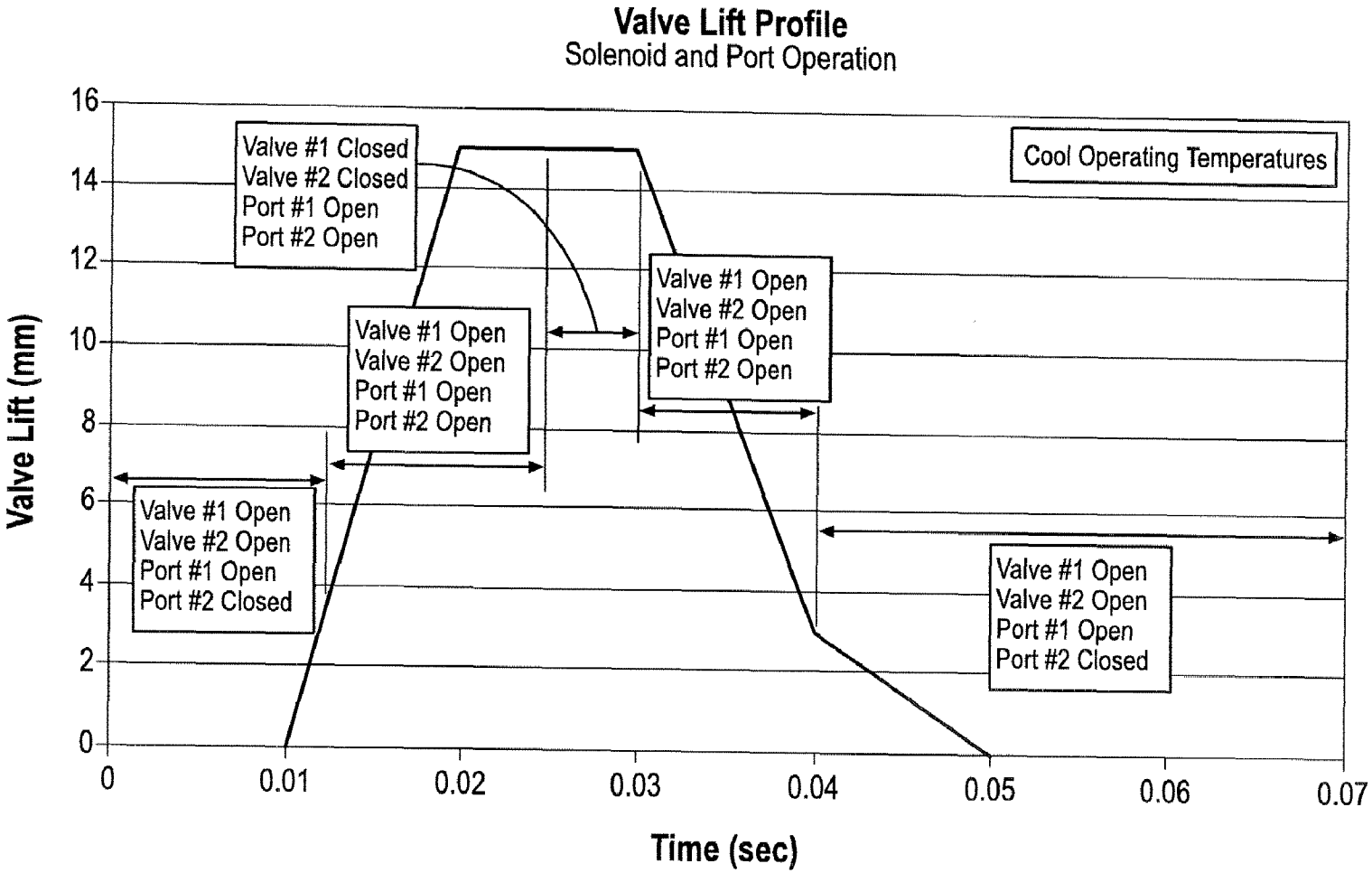
FIG. 6B is a graph that generally illustrates an open/closed valve configuration curve of the system of FIG. 1 when the system is operated under cool temperatures in accordance with an embodiment of the invention.

For example, in Winter, a vehicle may be called upon to start when the ambient temperature is, for example, −40° F.; accordingly, the fluid temperature sensor 16 may detect the operating temperature of the fluid 11 from the pump 14, which is then provided to the controller 22. If the detected temperature of the fluid 11 is below a predetermined operating temperature, the controller 22 may then provide a signal to the valve 20*b* to cause the valve 20*b* to move from the initially closed orientation to an open orientation (see, e.g. FIG. 6B) such that, at least for a portion of the lift profile of engine valve 108, the valves 20*a* and 20*b* are open at the same time in order to provide an increased fluid flow from the second fluid supply channel 50*b*, through the valve 20*b* for communication to the third port 40 to compensate for a decreased flow rate quantity of fluid 11 to the bottom and top ports 36, 38 through the first fluid supply channel 50*a*.

As the temperature of the fluid 11 rises (i.e., as the viscosity of the fluid 11 rises), the temperature sensor 16 provides a temperature signal to the controller 22 so that the controller 22 may compare the reading of the increased fluid temperature to determine if the increased temperature is greater than the predetermined operating temperature. Accordingly, the controller 22 may then command the valve 20*b* to move from the opened orientation to a closed orientation (see, e.g. FIG. 6A) such that the valves 20*a*, 20*b* are no longer open at the same time in order to decrease the flow of fluid 11 to the actuator volume 104, at least in part, to compensate for an increased flow rate quantity of the fluid 11 to the bottom and top port 36, 38 by way of the first supply port/channel 50*a*.

Accordingly, the temperature sensor 16 can function as a feedback link in a closed-loop control system for controlling the fluid 11 delivered to the valve system 100 in view of changes in operation temperature/viscosity associated with the fluid 11. As such, because the ambient temperature may affect the viscosity of the fluid 11, the valve 20*b* may be opened or closed in view of the sensed operating temperature of the fluid 11 detected by a temperature sensor 16. Thus, variations of the viscosity of the fluid 11 that could result in an inconsistency of the seating 403 and/or an inconsistency with a delayed closing movement 401 of an engine valve can be reduced or eliminated.

The present invention has been particularly shown and described with reference to the foregoing embodiments, which are merely illustrative of the best mode or modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A hydraulic circuit including an added motion valve system and a sump including fluid, wherein the fluid is defined by a flow rate, wherein a change in the flow rate is dependent upon a change in viscosity of the fluid, wherein the change in viscosity of the fluid is dependent upon a change in temperature of the fluid, comprising:

an added motion valve body defining an actuator volume, wherein the added motion valve body includes a first port, a second port, and a third port, wherein the added motion valve body receives the fluid flowing through a first fluid supply channel that is in fluid communication with the sump, and a second fluid supply channel that is in fluid communication with the sump, wherein the first fluid supply channel is in fluid communication with the first port and the second port, wherein the second fluid supply channel is in fluid communication with the third port;

means for selectively permitting movement of the fluid to and from the actuator volume, wherein the means for selectively permitting movement of the fluid to and from the actuator volume includes a first valve that is associated with the first fluid supply channel, wherein the first valve is movable between open and closed positions; and means for compensating for a positive flow rate of the fluid through the first fluid supply channel to the added motion valve body, wherein the means for compensating for the positive flow rate of the fluid through the first fluid supply channel to the added motion valve body includes a second valve associated with the second fluid supply channel, wherein the second valve is movable between open and closed positions, wherein the second valve is open at the same time as the first valve to compensate for the positive flow rate of the fluid through the first fluid supply channel to the added motion valve body.

2. The hydraulic circuit according to claim 1, wherein the added motion valve body the actuator volume defines a bore, wherein a piston is disposed in the bore.

3. The hydraulic circuit according to claim 2, wherein the actuator volume is disposed between an engine valve, and a cam system.

4. The hydraulic circuit according to claim 3, wherein the actuator volume is directly disposed between the cam system, and an engagement end of the engine valve.

5. The hydraulic circuit according to claim 2, wherein the open position of the first valve permits movement of the fluid into and out of the actuator volume, and the closed position of the first valve traps and prevents movement of the fluid into and out of the actuator volume.

6. The hydraulic circuit according to claim 5, wherein the first port sets a closing speed of the engine valve, and wherein the second port controls a seating velocity of the engine valve.

7. The hydraulic circuit according to claim 5, wherein the first port provides a first flow rate of the fluid to the actuator volume, and wherein the second port provides a second flow rate of the fluid to the actuator volume.

8. The hydraulic circuit according to claim 7, wherein the first flow rate is approximately a 22-liter-per-second flow rate of the fluid, and the second flow rate is approximately a 1-liter-per-second flow rate of the fluid.

9. The hydraulic circuit according to claim 5, wherein the open position of the second valve increased the flow rate of the fluid to the added motion valve body, and the closed position of the second valve decreases the flow rate of the fluid to the added motion valve body.

10. The hydraulic circuit according to claim 9 further comprising:

a fluid temperature sensor that detects the temperature of the fluid, and a controller for receiving the sensed temperature of the fluid from the fluid temperature sensor and for moving the second valve between open and closed positions.

11. The hydraulic circuit according to claim 9, wherein the second valve includes a first valve opening for permitting a movement of fluid by way of the second fluid supply channel, wherein the second valve further includes a lower valve opening, and an upper valve opening, wherein the lower and upper valve openings permit a movement of fluid to the third port.

12. A method for controlling a hydraulic circuit including fluid, wherein the fluid is defined by a flow rate, wherein an increase or decrease in the flow rate is dependent upon a decrease or increase in viscosity of the fluid, wherein the decrease or increase in viscosity of the fluid is dependent upon an increase or decrease in temperature of the fluid, comprising the steps of:

providing a potential for a flow of a fluid in a first fluid supply channel and a second fluid supply channel to an added motion actuator volume whereby the flow of fluid is passable through a first valve located in-line with the first fluid supply channel, and a second valve located in-line with the second fluid supply channel;

providing a flow of the fluid from the first supply channel to the added motion actuator volume by moving the first valve from a closed orientation to an open orientation;

detecting a temperature of fluid flowing in the first fluid supply channel;

if the detected temperature of the fluid flowing in the first fluid supply channel is below a predetermined fluid temperature, moving the second valve from an initially closed orientation to an open orientation at the same time the first valve is in the open orientation thereby increasing fluid flow to the added motion actuator volume.

13. The method according to claim 12 further comprising the steps of:

after decreasing the fluid flow to the added motion actuator volume, detecting the temperature of the fluid flowing in the first fluid supply channel; and if the detected temperature of the fluid is above a predetermined fluid temperature, moving the second valve from the open orientation to the initially closed orientation to decrease the fluid flow to the added motion actuator volume.

14. A hydraulic circuit including fluid, wherein the fluid is defined by a flow rate, wherein an increase or decrease in the flow rate is dependent upon a decrease or increase in viscosity of the fluid, wherein the decrease or increase in viscosity of the fluid is dependent upon an increase or decrease in temperature of the fluid, comprising:

a sump containing the fluid;

a fluid temperature sensor that detects temperature of the fluid;

an added motion valve body defining an actuator volume;

a first fluid supply channel and a second fluid supply channel that are each in fluid communication with the actuator volume and the sump;

means for selectively permitting movement of the fluid to and from the actuator volume, wherein the means for selectively permitting movement of the fluid to and from the actuator volume includes a first valve that is associated with the first fluid supply channel, wherein the first valve is movable between open and closed positions; and means for compensating for a flow rate of the fluid through the first fluid supply channel to the added motion valve body, wherein the means for compensating for the flow rate of the fluid through the first fluid supply channel to the added motion valve body includes a second valve associated with the second fluid supply channel, wherein the second valve is movable between open and closed positions, wherein the second valve is open at the same time as the first valve to compensate for the positive flow rate of the fluid through the first fluid supply channel to the added motion valve body.

15. The hydraulic circuit according to claim 14, wherein the added motion valve body includes:

a first port, a second port, and a third port, wherein the first fluid supply channel is in fluid communication with the first port and the second port, wherein the second fluid supply channel is in fluid communication with the third port.

16. The hydraulic circuit according to claim 14, wherein:

the open position of the first valve permits movement of the fluid into and out of the actuator volume, the closed position of the first valve traps and prevents movement of the fluid into and out of the actuator volume, the open position of the second valve increases the flow rate of the fluid to the added motion valve body, and the closed position of the second valve decreases the flow rate of the fluid to the added motion valve body.

17. The hydraulic circuit according to claim 14, further comprising:

a controller for receiving the sensed temperature of the fluid from the fluid temperature sensor to move the second valve between open and closed positions.

18. The hydraulic circuit according to claim 14, wherein the flow rate of the fluid through the first fluid supply channel of the means for compensating is a positive, non-zero flow rate.

19. A hydraulic circuit including an added motion valve system and a sump including fluid, wherein the fluid is defined by a flow rate, wherein a change in the flow rate is dependent upon a change in viscosity of the fluid, wherein the change in viscosity of the fluid is dependent upon a change in temperature of the fluid, comprising:

an added motion valve body defining an actuator volume, wherein the added motion valve body includes a first port, a second port, and a third port, wherein the added motion valve body receives the fluid flowing through a first fluid supply channel that is in fluid communication with the sump, and a second fluid supply channel that is in fluid communication with the sump, wherein the first fluid supply channel is in fluid communication with the first port and the second port, wherein the second fluid supply channel is in fluid communication with the third port;

means for selectively permitting movement of the fluid to and from the actuator volume, wherein the means for selectively permitting movement of the fluid to and from the actuator volume includes a first valve that is associated with the first fluid supply channel, wherein the first valve is movable to an open to provide a positive flow rate of the fluid through the first fluid supply channel to the added motion valve body; and means for compensating for the positive flow rate of the fluid through the first fluid supply channel to the added motion valve body, wherein the means for compensating for the positive flow rate of the fluid through the first fluid supply channel to the added motion valve body includes a second valve associated with the second fluid supply channel, wherein the second valve is movable between open and closed positions, wherein the second valve is moved from an initially-closed orientation to an open orientation to compensate for the positive flow rate of the fluid through the first fluid supply channel to the added motion valve body as a result of different fluid viscosities resulting from different fluid operating temperatures.

20. The hydraulic circuit according to claim 19, wherein the movement of the second valve from the initially-closed orientation to the open orientation is in response to the temperature of the fluid.

* * * * *